US008788853B2

(12) United States Patent
Talmadge et al.

(10) Patent No.: US 8,788,853 B2
(45) Date of Patent: Jul. 22, 2014

(54) METHOD AND APPARATUS FOR CLOSING A PATHWAY OF A POWER SUPPLY CIRCUIT BY CONFIGURING A DOOR LOCK IN LOCKED POSITION TO PRE-CHARGE A MOTOR DRIVE

(75) Inventors: Jonathan Blair Talmadge, Louisville, KY (US); Steven Michael Recio, Louisville, KY (US); Douglas Laurence Robertson, Louisville, KY (US)

(73) Assignee: General Electric Company, Schenectady, NY (US)

( * ) Notice: Subject to any disclaimer, the term of this patent is extended or adjusted under 35 U.S.C. 154(b) by 169 days.

(21) Appl. No.: 13/216,758

(22) Filed: Aug. 24, 2011

(65) Prior Publication Data

US 2013/0054982 A1 Feb. 28, 2013

(51) Int. Cl.
*G06F 1/00* (2006.01)

(52) U.S. Cl.
USPC ..... 713/300

(58) Field of Classification Search
CPC ..... D06F 39/087; D06F 29/00; D06F 37/308; D06F 33/02; D06F 67/005; A47B 81/00; H01H 35/34
See application file for complete search history.

(56) References Cited

U.S. PATENT DOCUMENTS

| | | | | |
|---|---|---|---|---|
| 2004/0047097 | A1* | 3/2004 | Jordan et al. | 361/92 |
| 2006/0187603 | A1* | 8/2006 | Chuang | 361/93.1 |
| 2011/0083476 | A1* | 4/2011 | Yang | 68/12.02 |
| 2012/0111065 | A1* | 5/2012 | Suel et al. | 68/12.16 |

FOREIGN PATENT DOCUMENTS

JP 11308864 A 11/1999

* cited by examiner

*Primary Examiner* — Thomas Lee
*Assistant Examiner* — Zhipeng Wang
(74) *Attorney, Agent, or Firm* — Global Patent Operation; Marc A. Vivenzio

(57) ABSTRACT

An appliance including a motor drive, a power supply circuit electrically coupling the motor drive to a power supply, a cabinet having an opening, a door for opening and closing the opening of the cabinet, and a door lock. When the door lock is in a locked position, the door lock is configured to secure the door and close a pathway of the power supply circuit thereby enabling a current to travel from the power supply through a pre-charge circuit to the motor drive.

20 Claims, 5 Drawing Sheets

METHOD AND APPARATUS FOR CLOSING A PATHWAY OF A POWER SUPPLY CIRCUIT BY CONFIGURING A DOOR LOCK IN LOCKED POSITION TO PRE-CHARGE A MOTOR DRIVE

BACKGROUND OF THE INVENTION

1. Field of the Invention

The field of the invention relates generally to washing machines, and, more particularly, to methods and apparatus for providing a current to a component for a washing machine by closing a pathway of a power supply circuit with a door lock.

2. Description of Related Art

Operation of a washing machine is typically controlled by a controller that is connected to a user interface input located on the washing machine. The user interface enables a user to select washing machine cycles and features. In response to a selection of a particular washing machine cycle and/or features, the controller operates various components of the washing machine to execute the selected washing machine cycle and/or features. For example, before a washing cycle begins, certain components (e.g., a motor drive) for the washing machine may need to be pre-charged. However, in order to supply power (e.g., a current) to a component, a circuit electrically coupling a power supply to the component needs to be closed to enable a current to reach the component. To accomplish this, conventional systems utilize one or more relays to close the circuit that electrically couples the power supply to the component.

BRIEF SUMMARY OF THE INVENTION

In one aspect, an appliance is provided. The appliance includes a motor drive, a power supply circuit electrically coupling the motor drive to a power supply, a cabinet having an opening, a door for opening and closing the opening of the cabinet, and a door lock configured to secure the door when the door lock is in a locked position, the door lock further configured to close a pathway of the power supply circuit when the door lock is in the locked position thereby enabling a current to travel from the power supply through a pre-charge circuit to the motor drive.

In another aspect, a controller configured to pre-charge a component for an appliance is provided. The controller includes a computer-readable memory for storing data indicative of current threshold levels, and a computer processor. The computer processor is programmed to receive instructions to begin an operation based on user defined settings, and initiate a pre-charging of the device by sending a signal to a door lock causing the door lock to move to a locked position, the door lock, upon movement to the locked position, is configured to close a pathway of a power supply circuit electrically coupling the device to a power supply thereby enabling a current to travel from the power supply through a pre-charge circuit to the device.

In yet another aspect, a method is provided. The method includes receiving instructions to begin an operation in an appliance, and initiating, by a computer processor, a pre-charging of a device for the appliance by sending a signal to a door lock causing the door lock to move to a locked position, the door lock, upon movement to the locked position, closes a pathway of a power supply circuit electrically coupling the device to a power supply thereby enabling a current to travel from the power supply through a pre-charge circuit to the device.

BRIEF DESCRIPTION OF THE SEVERAL VIEWS OF THE DRAWINGS

Non-limiting and non-exhaustive embodiments are described with reference to the following figures, wherein like reference numerals refer to like parts throughout the various views unless otherwise specified.

DETAILED DESCRIPTION OF THE INVENTION

Figure 1:
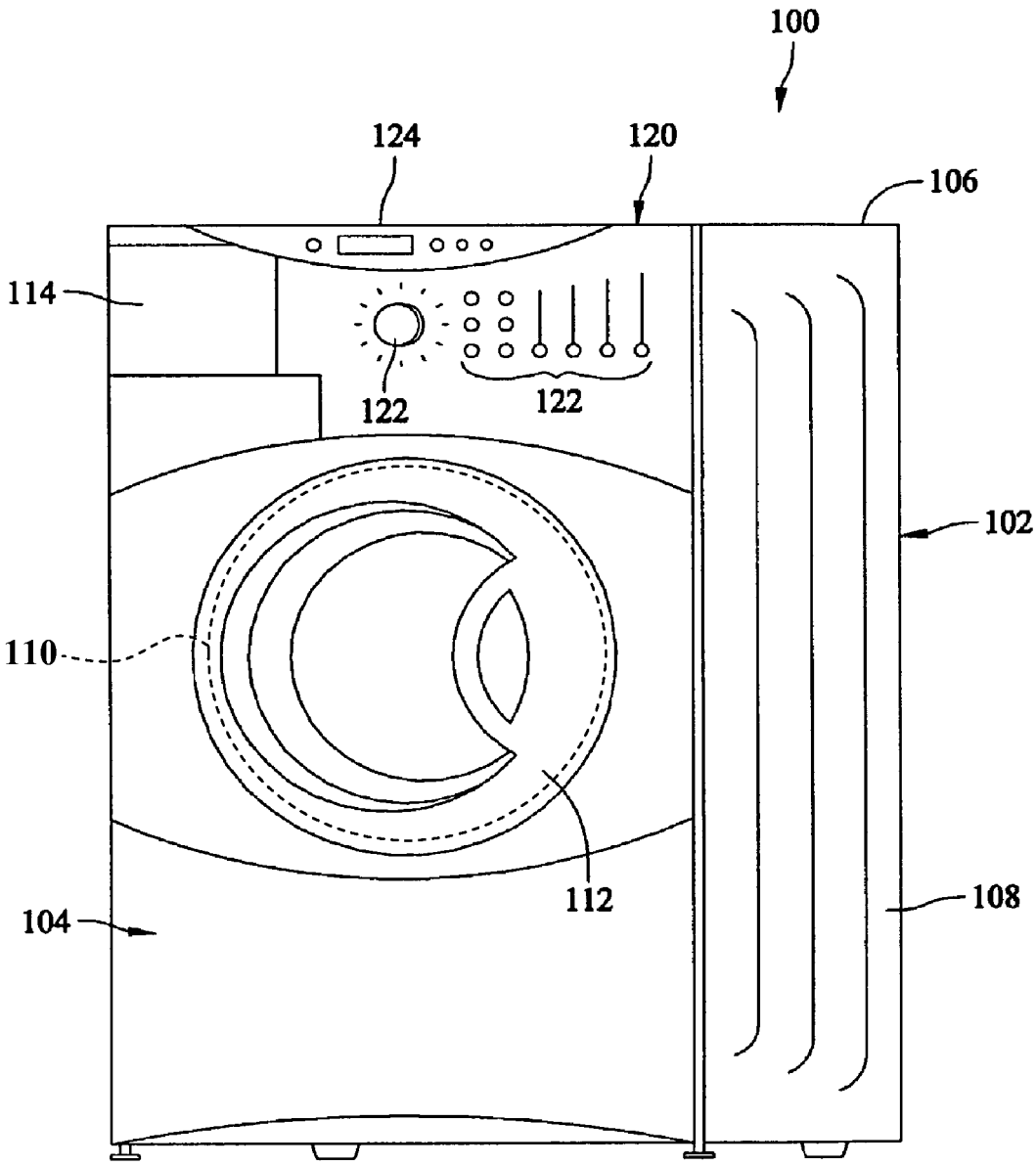
FIG. 1 is a perspective view of an exemplary washing machine.

FIG. 1 is a perspective view of an exemplary washing machine 100. While embodiments of the disclosure are illustrated and described herein with reference to washing machine 100 being a horizontal axis washing machine, aspects of the disclosure are operable with any appliance that performs the functionality illustrated and described herein, or its equivalent.

An exemplary technical effect of the methods and apparatus described herein includes at least one of (a) receiving instructions to begin an operation in an appliance; and (b) initiating, by a computer processor, a pre-charging of a device for the appliance by sending a signal to a door lock causing the door lock to move to a locked position, the door lock, upon movement to the locked position, is configured to close a pathway of a power supply circuit electrically coupling the device to a power supply thereby enabling a current to travel from the power supply through a pre-charge circuit to the device.

With reference back to FIG. 1, washing machine 100 includes a cabinet 102 having a front panel 104, a top panel 106, side panels 108, and an opening 110. A door 112 is mounted to front panel 104 and is rotatable about a hinge (not shown) between an open position (not shown) facilitating access to a basket (not shown) in an interior of washing machine 100 that holds a clothes load, and a closed position (as shown in FIG. 1) forming a substantially sealed enclosure over the basket. Front panel 104 may also includes a cover 114 that covers a lint filter user interface. A control panel 120 including a plurality of input selectors 122 is coupled to an upper portion of front panel 104. Control panel 120 and input selectors 122 collectively form a user interface for operator selection of washing machine cycles and features, and, in one embodiment, a display section 124 indicates selected features, machine status, and other items of interest to users. Operation of washing machine 100, and in particular, a variable speed motor drive (e.g., motor drive 306), is controlled by a controller 156 (described in further detail below with reference to FIG. 2) which is operatively coupled to the user interface.

Figure 2:
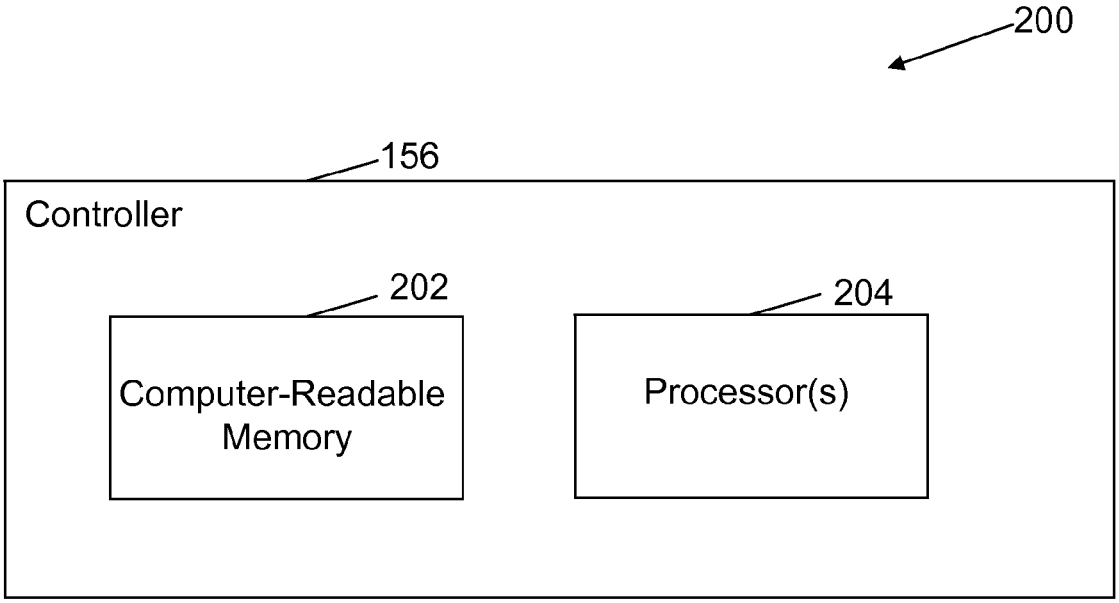
FIG. 2 is a schematic block diagram of a controller for a washing machine.

With reference now to FIG. 2, a schematic block diagram 200 of controller 156 is shown. Controller 156 includes a computer-readable memory 202 for storing data indicative of current threshold levels and/or user defined settings. Controller 156 further includes at least one computer processor 204 for executing computer-executable instructions for implementing aspects of the disclosure. In general, computer processor 204 may be programmed with the operations as described herein with reference to the components illustrated in FIG. 3, and the operations illustrated in FIG. 5. In some embodiments, computer processor 204 is transformed into a special purpose microprocessor by executing computer-executable instructions or by otherwise being programmed.

In response to a selection of a particular washing machine cycle and/or features, controller 156 operates various components of an appliance (e.g., washing machine 100) to execute selected operations (e.g., a washing cycle) and/or features. However, before a washing cycle begins, a motor drive, and more specifically, capacitors on a motor controller may be pre-charged to prevent generating an inrush current that could potentially damage components of washing machine 100 as well as creating a dimming effect on lights in a consumer's home.

As mentioned above, to initiate a pre-charging of a component in conventional systems, a circuit supplying a current to a component that is going to be pre-charged is closed using one or more relays. However, unlike conventional systems, embodiments of the present disclosure utilize a door lock to close a pathway of a circuit supplying a current to a component.

Figure 3:
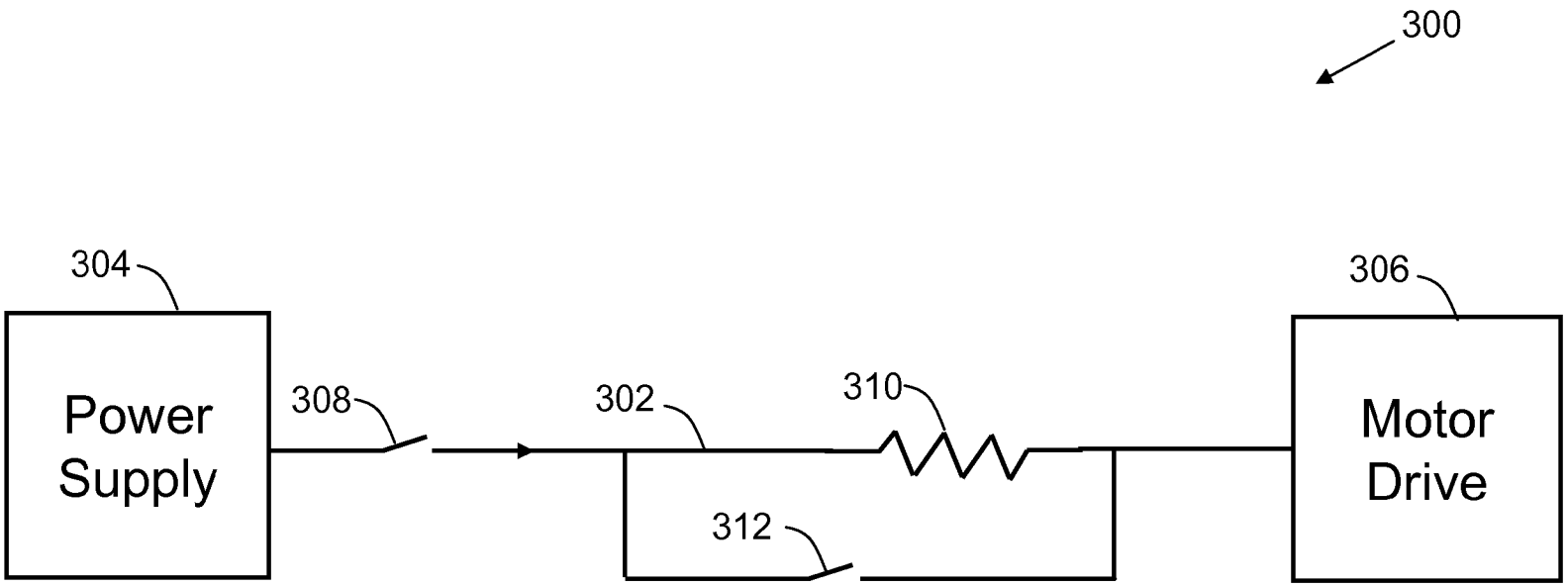
FIG. 3 is a block diagram of a power supply circuit for a washing machine.

With reference now to FIG. 3, an exemplary block diagram 300 of a power supply circuit 302 for an appliance (e.g., washing machine 100 shown in FIG. 1) is shown. Power supply circuit 302 electrically couples a power supply 304 to component 306, which, in one embodiment, is a motor drive. To close a pathway of power supply circuit 302, a door lock 308 for door 112 (as shown in FIG. 1) is provided. Door lock 308 may be a conventional door lock for a horizontal axis washing machine (e.g., washing machine 100). As shown in FIG. 3, door lock 308 is in an unlocked position, and therefore, power supply circuit 302 is unable to supply a current to component 306. However, when controller 156 receives instructions to begin a washing cycle, and upon a verification that door 112 is in a closed position, controller 156 sends a signal to door lock 308 that causes door lock 308 to move to a locked position via, for example, a solenoid coil, a lock motor, or a wax motor (not shown), thereby closing a pathway of power supply circuit 302 and enabling a current to travel from power supply 304 to motor drive 306. In one embodiment, controller 156 initiates a door locking process once a washing cycle requires use of motor drive 306. Door lock 308 may include contacts for closing a pathway of power supply circuit 302 when door lock 308 is in the locked position. Using door lock 308 to close the pathway of power supply circuit 302 eliminates a need to use a relay to close the pathway of power supply circuit 302.

Figure 4:
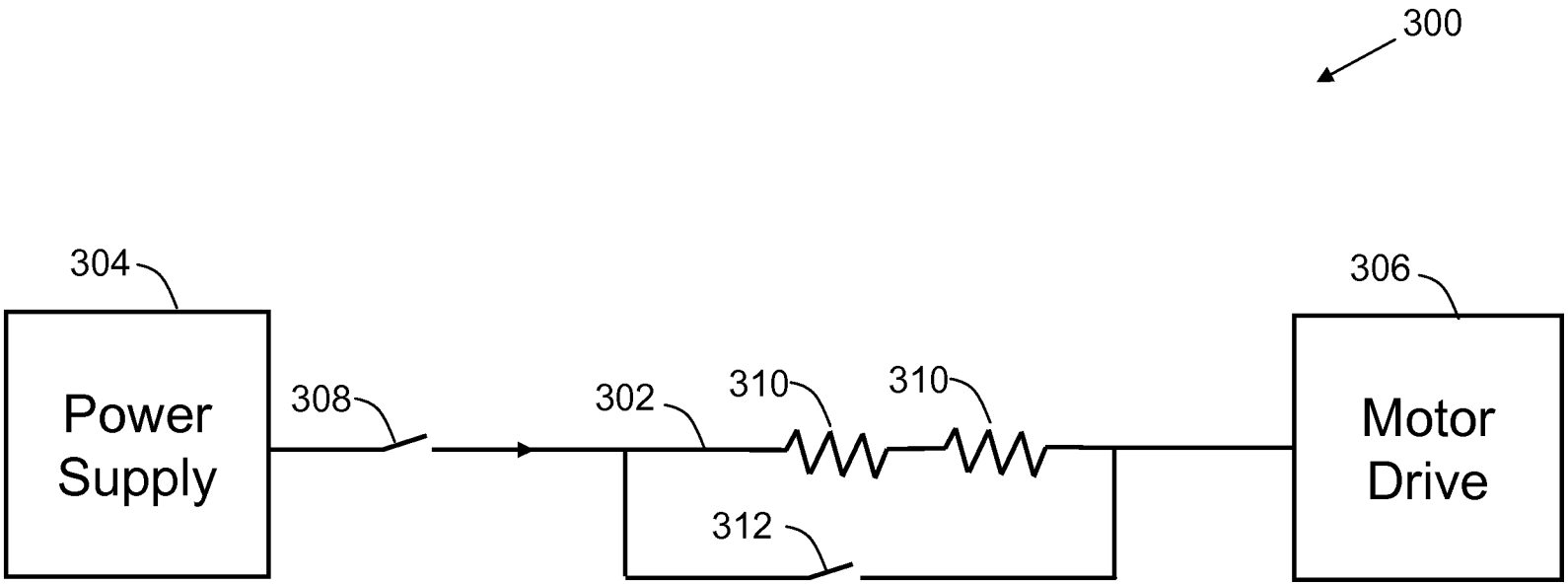
FIG. 4 is a block diagram of a power supply circuit including a plurality of resistors in a series.

In one embodiment, to limit the current supplied from power supply 304 to motor drive 306, power supply circuit 302 further includes a resistor 310 configured to limit the current supplied to motor drive 306 to be below a current threshold level, for example, about 10 Amps. One of ordinary skill in the art guided by the teachings herein will appreciate that a plurality of resistors may be used to limit the current supplied to motor drive 306. For example, due to a usage condition or a level of an inrush current resistor 310 may be exposed to, a plurality or resistors (in a series as shown in FIG. 4 or in parallel) may be used.

In one embodiment, controller 156 determines, using computer processor 204, when the pre-charging of motor drive 306 is complete. For example, the pre-charging of motor drive 306 may take a pre-defined period of time. Thus, processor 204 may determine that the pre-charging of motor drive 306 is complete after the pre-defined time period has lapsed. In one embodiment, processor 204 may receive a pre-charging status update from motor drive 306, and more specifically, the motor controller, indicating that the pre-charging of motor drive 306 is complete. Once the pre-charging of motor drive 306 is complete, resistor 310 is bypassed by a relay 312. Bypassing resistor 310 enables a non-limited current to be supplied to motor drive 306 and other components of washing machine 100 as the selected washing cycle proceeds.

Figure 5:
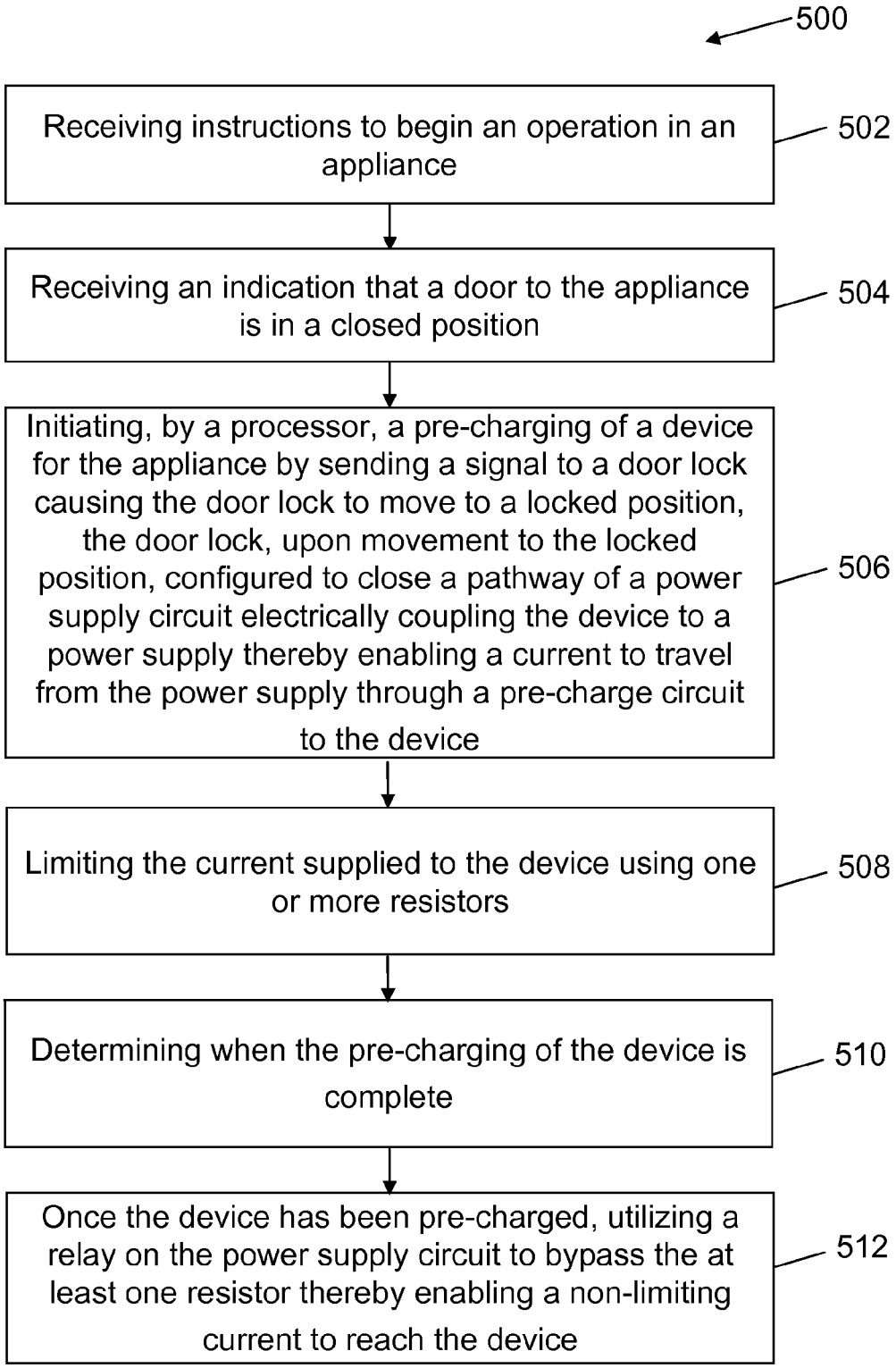
FIG. 5 is a diagram illustrating a process for providing a current to a component for a washing machine by closing a pathway of a power supply circuit with a door lock.

FIG. 5, is an exemplary flow chart illustrating a process 500 for providing a current to motor drive 306 (as shown in FIG. 3) by closing a pathway of power supply circuit 302 (as shown in FIG. 3) with door lock 308 (as shown in FIG. 3). The process includes receiving instructions at 502 to begin an operation in an appliance (e.g., a washing cycle in washing machine 100 as shown in FIG. 1). At 504, an indication that door 112 (as shown in FIG. 1) is in a closed position is received. At 506, a pre-charging of motor drive 306 is initiated by sending a signal to door lock 308 that causes door lock 308 to move to a locked position. Upon movement to the locked position, door lock 308 closes a pathway of power supply circuit 302 electrically coupling motor drive 306 to power supply 304 (as shown in FIG. 3) thereby enabling a current to travel from power supply 304 to motor drive 306. At 508, a current supplied to motor drive 306 is limited by way of one or more resistors 310 (as shown in FIGS. 3 and 4) configured to limit the current below a current threshold level. At 510, it is determined when the pre-charging of motor drive 306 is complete, and at 512, once motor drive 306 has been pre-charged, relay 312 (as shown in FIG. 3) on power supply circuit 302 is utilized to bypass resistor 310 thereby enabling a non-limiting current to reach motor drive 306.

EXEMPLARY OPERATING ENVIRONMENT

A controller or computing device such as described herein has one or more processors or processing units, computer-readable memory, and some form of computer readable media. By way of example and not limitation, computer readable media include computer storage media and communication media. Computer storage media include volatile and nonvolatile, removable and non-removable media implemented in any method or technology for storage of information such as computer readable instructions, data structures, program modules or other data. Communication media typically embody computer readable instructions, data structures, program modules, or other data in a modulated data signal, such as a carrier wave or other transport mechanism, and include any information delivery media. Combinations of any of the above are also included within the scope of computer readable media.

Embodiments of the present disclosure may be described in the general context of computer-executable instructions, such as program modules, executed by one or more computers or other devices. The computer-executable instructions may be organized into one or more computer-executable components or modules. Generally, program modules include, but are not limited to, routines, programs, objects, components, and data structures that perform particular tasks or implement particular abstract data types. Aspects of the present disclosure may be implemented with any number and organization of such components or modules. For example, aspects of the present disclosure are not limited to the specific computer-executable instructions or the specific components or modules illustrated in the figures and described herein.

The order of execution or performance of the operations in embodiments of the present disclosure illustrated and described herein is not essential, unless otherwise specified. That is, the operations may be performed in any order, unless otherwise specified, and embodiments of the present disclosure may include additional or fewer operations than those disclosed herein. For example, it is contemplated that executing or performing a particular operation before, contemporaneously with, or after another operation is within the scope of aspects of the present disclosure.

When introducing elements of aspects of the present disclosure or the embodiments thereof, the articles "a," "an," "the," and "said" are intended to mean that there are one or more of the elements. The terms "comprising," "including," and "having" are intended to be inclusive and mean that there may be additional elements other than the listed elements.

Having described aspects of the present disclosure in detail, it will be apparent that modifications and variations are possible without departing from the scope of aspects of the present disclosure as defined in the appended claims. As various changes could be made in the above constructions, products, and methods without departing from the scope of aspects of the present disclosure, it is intended that all matter contained in the above description and shown in the accompanying drawings shall be interpreted as illustrative and not in a limiting sense.

This written description uses examples to disclose the claimed subject matter, including the best mode, and also to enable any person skilled in the art to practice the claimed subject matter, including making and using any devices or systems and performing any incorporated methods. The patentable scope of the present disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An appliance comprising:

a motor drive;

a power supply circuit electrically coupling the motor drive to a power supply;

a precharge circuit electrically coupled in series between the power supply and the motor drive;

a relay electrically coupled in parallel with the precharge circuit;

a cabinet having an opening;

a door for opening and closing the opening of the cabinet;

a door lock configured to secure the door when the door lock is in a locked position, the door lock further configured to close a pathway of the power supply circuit when the door lock is in the locked position thereby enabling a current to travel from the power supply through the pre-charge circuit to the motor drive; and a controller configured to:

detect a request to begin an operation of the appliance;

initiate a door locking process to secure the door with the door lock;

detect when a pre-charge of the motor is complete; and close the relay to bypass the precharge circuit and electrically couple the power supply to the motor supply.

2. An appliance in accordance with claim 1, wherein the power supply circuit comprises at least one resistor configured to limit the motor drive current below a current threshold level.

3. An appliance in accordance with claim 2, wherein the current threshold level is about 10 Amps.

4. An appliance in accordance with claim 2, wherein the at least one resistor comprises a plurality of resistors in series.

5. An appliance in accordance with claim 2, wherein the power supply circuit comprises a relay configured to bypass the at least one resistor after the motor drive is charged thereby enabling a non-limiting current to reach the motor drive.

6. An appliance in accordance with claim 5, wherein the motor drive is a variable speed motor drive.

7. An appliance in accordance with claim wherein the appliance is a horizontal axis washing machine.

8. A controller configured to pre-charge a device for an appliance, the controller comprising:

a computer-readable memory for storing data indicative of current threshold levels; and a computer processor programmed to:

receive instructions to begin an operation based on user defined settings;

initiate a pre-charging of the device by sending a signal to a door lock causing the door lock to move to a locked position, the door lock, upon movement to the locked position, configured to close a pathway of a power supply circuit electrically coupling the device to a power supply thereby enabling a current to travel from the power supply through a pre-charge circuit to the device;

detecting when the pre-charge of the device is complete; and closing a relay to bypass the pre-charge circuit and provide electrical power directly to the device.

9. A controller in accordance with claim 8, wherein the power supply circuit comprises at least one resistor configured to limit the current to the device below a current threshold level.

10. A controller in accordance with claim 9, wherein the at least one resistor comprises a plurality of resistors in series.

11. A controller in accordance with claim 9, wherein the computer processor is further programmed to:

determine when the pre-charging of the device is complete; and once the device has been pre-charged, utilize the relay on the power supply circuit to bypass the at least one resistor thereby enabling a non-limiting current to reach the device.

12. A controller in accordance with claim 11, wherein the device is a variable speed motor drive.

13. A controller in accordance with claim 8, wherein the power supply circuit comprises at least one resistor configured to limit the current below about 10 Amps.

14. A method comprising:

receiving instructions to begin an operation in an appliance; and initiating, by a computer processor, a pre-charging of a device for the appliance by sending a signal to a door lock causing the door lock to move to a locked position, the door lock, upon movement to the locked position, configured to close a pathway of a power supply circuit electrically coupling the device to a power supply thereby enabling a current to travel from the power supply through a pre-charge circuit to the device;

detect when the pre-charge of the device is complete; and close a relay to bypass the pre-charge circuit and provide electrical power directly to the device.

15. A method in accordance with claim 14, further comprising limiting the current being supplied to the device by way of a resistor configured to limit the current below a current threshold level.

16. A method in accordance with claim 14, further comprising limiting the current being supplied to the device by a plurality of resistors in series, the plurality of resistors configured to limit the current below a current threshold level.

17. A method in accordance with claim 14, further comprising:

determining when the pre-charging of the device is complete; and once the device has been pre-charged, utilizing the relay on the power supply circuit to bypass the at least one resistor thereby enabling a non-limiting current to reach the device.

18. A method in accordance with claim 14, further comprising limiting the current supplied to the device using a resistor configured to limit the current below about 10 Amps.

19. A method in accordance with claim 14, wherein the device is a motor drive.

20. A method in accordance with claim 19, wherein the motor drive is a variable speed motor drive.

* * * * *

UNITED STATES PATENT AND TRADEMARK OFFICE

CERTIFICATE OF CORRECTION

PATENT NO. : 8,788,853 B2
APPLICATION NO. : 13/216758
DATED : July 22, 2014
INVENTOR(S) : Talmadge et al.

It is certified that error appears in the above-identified patent and that said Letters Patent is hereby corrected as shown below:

In the Claims:

In Column 6, Line 13, in Claim 7, delete "claim" and insert -- claim 1, --, therefor.

Signed and Sealed this
Twenty-eighth Day of April, 2015

Michelle K. Lee

Michelle K. Lee
*Director of the United States Patent and Trademark Office*